US006857770B2

(12) United States Patent
Moore

(10) Patent No.: US 6,857,770 B2
(45) Date of Patent: Feb. 22, 2005

(54) ILLUMINATED FLYING DISC

(76) Inventor: Jerry Moore, 5777 Central Ave., Suite 110, Boulder, CO (US) 80301

( * ) Notice: Subject to any disclaimer, the term of this patent is extended or adjusted under 35 U.S.C. 154(b) by 69 days.

(21) Appl. No.: 10/607,786

(22) Filed: Jun. 27, 2003

(65) Prior Publication Data

US 2004/0022070 A1 Feb. 5, 2004

Related U.S. Application Data

(60) Provisional application No. 60/392,824, filed on Jun. 28, 2002.

(51) Int. Cl.[7] ..... F21V 7/04; G02B 6/04

(52) U.S. Cl. ..... 362/554; 362/556; 362/555; 362/565; 362/581; 362/253; 446/46

(58) Field of Search ..... 362/554, 551, 362/556, 555, 109, 201, 800, 565, 581, 253; 446/242, 46, 47, 48; 473/588, 589–590

(56) References Cited

U.S. PATENT DOCUMENTS

| | | | |
|---|---|---|---|
| 3,720,018 | A | 3/1973 | Peterson et al. |
| 3,786,246 | A | 1/1974 | Johnson et al. |
| 3,812,614 | A | 5/1974 | Harrington |
| 3,948,523 | A | 4/1976 | Michael |
| 4,086,723 | A | 5/1978 | Strawick |
| 4,132,031 | A | 1/1979 | Psyras |
| 4,135,324 | A | 1/1979 | Miller et al. |
| 4,145,839 | A | 3/1979 | Sampietro |
| 4,207,702 | A | 6/1980 | Boatman et al. |
| 4,248,010 | A | 2/1981 | Fox |
| 4,254,575 | A | 3/1981 | Gould |
| D260,786 | S | 9/1981 | Chaklos |
| 4,301,616 | A | 11/1981 | Gudgel |
| 4,307,538 | A | 12/1981 | Moffitt |
| 4,431,196 | A | 2/1984 | Kutnyak |
| 4,435,917 | A | 3/1984 | Lee |
| 4,515,570 | A | 5/1985 | Beltran |
| 4,563,160 | A | 1/1986 | Lee |
| 4,607,850 | A | 8/1986 | O'Riley |
| D286,657 | S | 11/1986 | Fields |
| 4,778,428 | A | 10/1988 | Wield |
| 4,846,749 | A | 7/1989 | Petko |
| 5,032,098 | A | 7/1991 | Balogh et al. |
| D337,134 | S | 7/1993 | Scruggs et al. |
| 5,290,184 | A | 3/1994 | Balogh et al. |
| 5,319,531 | A | 6/1994 | Kutnyak |
| D350,783 | S | 9/1994 | Bacon |
| 5,536,195 | A | 7/1996 | Stamos |
| 5,611,720 | A | 3/1997 | Vandermaas |
| D386,221 | S | 11/1997 | Ybanez |
| D390,282 | S | 2/1998 | Burdick |
| 5,902,166 | A | 5/1999 | Robb |
| 5,931,716 | A | 8/1999 | Hopkins et al. |
| 2004/0037090 | A1 * | 2/2004 | Jacobs et al. ..... 362/556 |

* cited by examiner

*Primary Examiner*—Stephen Husar
*Assistant Examiner*—Sharon Payne
(74) *Attorney, Agent, or Firm*—Patton Boggs LLP

(57) ABSTRACT

A recreational or competitive flying disc includes an illumination system employing an array of flexible optical fibers to distribute the light of a single light emitting diode (LED) from the rotational center of the disc to its outside periphery. A small water-resistant compartment centered on the underside of the disc houses the LED, battery, and the illumination control. The leads of the LED also serve as the contacts of the battery. One end of each of the optical fibers is embedded in the LED, and the other end extends radially from the central housing on the underside surface of the disc to the rim of the disc. The flying disc is illuminated without altering the aerodynamic properties of the disc.

10 Claims, 8 Drawing Sheets

ILLUMINATED FLYING DISC

CROSS-REFERENCE TO RELATED APPLICATIONS

This application claims priority from U.S. Provisional Application Ser. No. 60/392,824 filed 28 Jun. 2002. The entirety of this provisional application is incorporated herein by reference.

BACKGROUND OF THE INVENTION

1. Field of the Invention

The invention in general relates to an illuminated aerodynamic toy/athletic device, and, more particularly, to illuminated flying discs.

2. Statement of the Problem

The FRISBEE™ and similar flying discs are well-known devices used as toys and in sports activities. Numerous attempts have been made to improve these flying discs by adding lighting systems to allow effective use of the flying disc in darkness or low light conditions. See, for example: U.S. Pat. No. 3,720,018 issued Mar. 13, 1973 to Peterson et al.; U.S. Pat. No. 3,786,246 issued Jan. 15, 1974 to Johnson et al.; U.S. Pat. No. 3,812,614 issued May 28, 1974 to Richard H. Harrington; U.S. Pat. No. 3,948,523 issued Apr. 6, 1976 to Henry G. Michael; U.S. Pat. No. 4,086,723 issued May 2, 1978 to Raymond L. Strawick; U.S. Pat. No. 4,132,031 issued Jan. 2, 1979 to Louis G. Psyras; U.S. Pat. No. 4,135,324 issued Jan. 23, 1979 to Miller et al.; U.S. Pat. No. 4,145,839 issued Mar. 27, 1979 to Joseph M. Sampietro; U.S. Pat. No. 4,207,702 issued Jun. 17, 1980 to Boatman et al.; U.S. Pat. No. 4,248,010 issued Feb. 3, 1981 to Daniel W. Fox; U.S. Pat. No. 4,254,575 issued Mar. 10, 1981 to Arnold S. Gould; U.S. Design Pat. No. 260,786 issued Sep. 15, 1981 to Stanley C. Chaklos; U.S. Pat. No. 4,301,616 issued Nov. 24, 1981 to Terry J. Gudgel; U.S. Pat. No. 4,307,538 issued Dec. 29, 1981 to Keith S. Moffitt; U.S. Pat. No. 4,431,196 issued Feb. 14, 1984 to Mark R. Kutnyak; U.S. Pat. No. 4,435,917 issued Mar. 13, 1984 to William B. Lee; U.S. Pat. No. 4,515,570 issued May 7, 1985 to Edward R. Beltran; U.S. Pat. No. 4,563,160 issued Jan. 7, 1986 to William B. Lee; U.S. Pat. No. 4,607,850 issued Aug. 26, 1986 to Henry M. O'Riley; U.S. Design Pat. No. 286,657 issued Nov. 11, 1986 to Tom Fields; U.S. Pat. No. 4,778,428 issued Oct. 18, 1988 to Paul J. Wield; U.S. Pat. No. 4,846,749 issued Jul. 11, 1989 to Charles J. Petko; U.S. Pat. No. 5,032,098 issued Jul. 16, 1991 to Balogh et al.; U.S. Design Pat. No. 337,134 issued Jul. 6, 1993 to Scruggs et al.; U.S. Pat. No. 5,290,184 issued Mar. 1, 1994 to Balogh et al.; U.S. Pat. No. 5,319,531 issued Jun. 7, 1994 to Mark R. Kutnyak; U.S. Design Pat. No. 350,783 issued Sep. 20, 1994 to Jerry R. Bacon; U.S. Pat. No. 5,536,195 issued Jul. 16, 1996 to Bryan W. Stamos; U.S. Pat. No. 5,611,720 issued Mar. 18, 1997 to John Vandermaas; U.S. Pat. No. 5,902,166 issued May. 11, 1999 to Charles L. R. Robb; U.S. Design Pat. No. 386,221 issued Nov. 11, 1997 to Steven R. Ybanez; U.S. Design Pat. No. 390,282 issued Feb. 3, 1998 to Brett Burdick; and U.S. Pat. No. 5,931,716 issued Aug. 3, 1999 to Hopkins et al. These attempts can be categorized into three basic approaches as follows.

One of the earliest systems was to use "glow-in-the-dark" materials integrated into the structure of the disc or added by means of special coating materials. Although the disc produces a glow at night, the phosphorescent material is ineffective during the twilight hours due to high ambient light level. In addition, the glow is not long lasting and such discs require frequent and inconvenient "recharging" by exposure to a strong light source.

Other systems employ chemilucent liquids as a light source, but these require bulky compartments to house the liquid and the liquid itself is heavy. In addition, once the chemical reaction is initiated, the usable light output only lasts a few hours and the chemilucent material must be discarded and replenished after each use.

More recent illumination systems employ multiple light emitting diodes (LEDs). However, even with complex dimming, pulsing, or other energy conserving circuitry, the use of multiple LEDs creates a relatively large drain on any battery and requires substantially larger batteries and/or their frequent replacement. The additional mass and volume required to house multiple LEDs, metallic wiring, complex control circuitry, and bulky disposable batteries severely degrades the flight characteristics of the disc. In addition, the complex circuitry is susceptible to damage resulting in low durability and a short lifetime for the device. Further, the complexity of these systems significantly increases the cost of the flying disc.

In addition to the bulky wiring configurations, some of these illumination systems employ screw-type caps that function as a switch by pressing the LED leads against the wiring connected to battery terminals as the cap is screwed down. Many times these screw-type caps are over-tightened, which flatten the electrical contacts and leads and cause deteriorating electrical connections. Further, these screw-type caps have battery compartments that are shaped to hold a battery, but not grip the battery tight, which allows the battery to slightly move from side to side inside its compartment. This movement further deteriorates the electrical contacts and leads inside the battery compartment. Furthermore, the switch could be accidentally activated when the user is closing the battery compartment.

Despite the numerous attempts to provide an illuminated flying disc, there does not yet exist an illuminated disc that combines low power consumption, volume, and weight, with high durability, normal flying disc flight characteristics and relatively low cost. None of these provide for bright, long-lasting illumination of the entire disc without adding weight or bulk, which unduly affects the flight characteristics of the flying disc. Further, those designs that provide the most effective illumination suffer from low durability and high cost. Thus, there is needed a flying disc having an illumination system that combines low power consumption, volume, and weight, with high durability, normal flying disc flight characteristics and relatively low cost.

SUMMARY OF THE INVENTION

The invention solves the above problem by providing an illuminated flying disc with a simple, compact lighting system. In the preferred embodiment, the illuminated flying disc has no protrusions on the flat disc and therefore performs like the best unlighted flying discs. One inventive feature is that the illuminated flying disc includes optical fiber material that has one end embedded in the LED casing to provide distribution of light throughout the disc without requiring the use of multiple LEDs. Preferably, the optical fiber material is contained in a translucent rib, and more preferably in a channel formed in the rib. Preferably, the channel does not go to the edge of the flying disc but abuts the inside of the translucent annular rim. A further inventive feature is that the leads of the LED chip contact the battery terminals directly, thereby providing substantially less wiring than the prior art and also affording solderless connections.

The invention provides a flying disc comprising: a disc-shaped body member having a first surface and a second surface and terminating at its periphery in an annular rim; the first surface being essentially flat; the rim extending in a direction substantially away from the plane of the first surface and together with the second surface defining a semi-enclosed space; an electronics housing centrally located on the second surface, located entirely within the semi-enclosed space with no portion thereof protruding from the first surface, and having a maximum external housing radius of one-fourth or less of the radius of the annular rim; an electronic source of light located entirely within the electronics housing; and an optical fiber located to receive light from the light source. More preferably, the maximum external radius of the electronics housing is one-fifth or less of the radius of the annular rim. Most preferably, the maximum external radius of the electronics housing is one-seventh or less of the radius of the annular rim. Preferably, the electronics housing is circular. Preferably, the external radius of the circular electronics housing ranges from 0.75 inches to 1.5 inches. Preferably, the electronic source of light comprises an LED and a battery. Preferably, the flying disc further includes a dual battery adapter and there are two of the batteries located in the adapter. Preferably, the flying disc further includes a rib attached to the second surface and the optical fiber is located within the rib. Preferably, the electronic source of light includes a light switch.

The invention also provides an aerodynamic toy/athletic device comprising: a gliding body terminating at its periphery in an annular rim; a light source attached to the gliding body, the light source including only one light emitting diode (LED), the LED comprising a semiconductor chip embedded in a dielectric casing; and a plurality of optical fibers attached to the gliding body, each optical fiber having one end embedded in the dielectric casing. Preferably, the LED is substantially centrally located on the gliding body. Preferably, the light source further includes a battery, the LED further includes a pair of electrical leads, and the electrical leads directly contact the battery. Preferably, the gliding body comprises a disc-shaped body member having a first surface and a second surface and terminating at its periphery in an annular rim; the rim extending in a direction substantially away from the plane of the first surface and together with the second surface defining a semi-enclosed space. Preferably, the aerodynamic toy/athletic device further includes a plurality of ribs attached to the second surface, and one of the optical fibers is located in each of the ribs. Preferably, each of the ribs further includes a channel formed in the rib and the optical fiber associated with the rib is located in the channel. Preferably, the channels do not penetrate the inside edge of the rim. Preferably, the disc-shaped body, the rim, and the channels are translucent. Preferably, the ribs further include an opening formed in the ribs wherein the opening has a smaller diameter than the channel.

In another aspect, the invention provides an aerodynamic toy/athletic device comprising: a gliding body terminating at its periphery in an annular rim; and a light source attached to the gliding body, the light source comprising: a light emitting diode (LED), the LED comprising a semiconductor chip embedded in a dielectric casing; a pair of electrical leads attached to the semiconductor chip; and a battery source; wherein the electrical leads directly contact the battery source. Preferably, the gliding body further includes an optical fiber material attached to the gliding body and located to receive light from the light source. Preferably, the gliding body comprises a disc-shaped body member having a first surface and a second surface and terminating at its periphery in an annular rim; the rim extending in a direction substantially away from the plane of the disc and together with the second surface defining a semi-enclosed space. Preferably, the aerodynamic toy/athletic device further includes a plurality of ribs attached to the second surface, and wherein one of the optical fiber material is located in each of the ribs. Preferably, the channels abut but do not penetrate the inside edge of the rim. Preferably, the battery source comprises a dual battery assembly including a dual battery adapter and a first battery and a second battery located in the adapter; and the first lead contacts the first battery and the second lead contacts the second battery.

In a further aspect, the invention provides a flying disc comprising: a disc-shaped body member having a first surface and a second surface and terminating at its periphery in an annular rim; the first surface being essentially flat; the rim extending in a direction substantially away from the plane of the disc and together with the second surface defining a semi-enclosed space; an electronics housing centrally located on the second surface; an electronic source of light located entirely within the electronics housing; a plurality of ribs attached to the second surface and extending radially from the electronics housing; and a plurality of optical fibers, each optical fiber located in one of the ribs. Preferably, each of the ribs further includes a channel formed in the rib and the optical fiber associated with the rib is located in the channel. Preferably, the channels abut but do not penetrate the inside edge of the rim. Preferably, the channels include a lip for retaining the optical fibers. Preferably, the electronics housing includes a base member, a battery, and a cap, wherein the battery is located between the base member and the cap.

In yet another aspect, the invention also provides a method of making an illuminated flying disc, the method comprising: providing a gliding body having a disc-shaped member and an annular rim integrally formed with the disc-shaped member, the annular rim extending in a direction substantially away from the plane of the disc-shaped member; the inner surface of the rim and the lower surface of the disc-shaped member defining a semi-enclosed space; the gliding body including an aerodynamic surface including the upper surface of the disc-shaped member and the outer surface of the annular rim; and integrating an electronic illumination system into the flying disc without altering the aerodynamic properties of the aerodynamic surface. Preferably, the method further includes forming aerodynamic ridges in the aerodynamic surface.

In still a further aspect, the invention provides a method of illuminating a flying disc, the method comprising: providing a flying disc having an electronics chamber and an LED within the electronics chamber, the LED including a semiconductor chip embedded in a dielectric and a first electrical lead and a second electrical lead attached to the semiconductor chip; placing a battery assembly in the electronics chamber so that a first conducting portion of the battery assembly directly contacts the first electrical lead; and directly contacting a second portion of the battery assembly with the second electrical lead. Preferably, the battery assembly comprises a single battery. Preferably, the battery assembly comprises a dual battery assembly.

In still another aspect, the invention provides a switchable light source for a flying disc including a first surface and a second surface comprising: a base member including a plurality of base elements; a cap that covers the base elements; a battery assembly having a first terminal and a second terminal located between the base elements and the cap; and a light emitting diode (LED) having a first lead located in contact with the first terminal and a second lead located substantially adjacent to one of the base elements; wherein rotating the cap forces the one of the base elements towards the second terminal and the second lead into contact with the second terminal. Preferably, the cap is rotatable between a first position and a second position. Preferably, the cap includes a cam that doesn't engage the one of the base elements when the cap is in the first position and engages the one of the base elements when the cap is in the second position. Preferably, the one of the base elements is abbreviated to form an opening and wherein the cam is located substantially in the opening when the cap is in the first position. Preferably, the switchable light source further includes a detent engageable by the cap to hold the cap in the second position.

In yet another aspect, the invention provides a flying disc comprising: a disc-shaped body member having a first surface and a second surface and terminating at its periphery in an annular rim; the first surface being essentially flat; the rim extending in a direction substantially away from the plane of the disc and together with the second surface defining a semi-enclosed space; an electronics housing located on the second surface; the electronics housing comprising: a base member including a plurality of flexible base elements; a cap that covers the base elements; a battery support creating an electronics recess between the battery and the second surface; and disc-illuminating electronics in the electronics recess; wherein the base members cap and battery support are located and adapted such that when the cap is placed on the base elements, the base elements and cap grip the battery forming a rigid electronic housing structure that protects the disc illuminating electronics. Preferably, the base elements extend substantially perpendicular from the second surface. Preferably, the base elements further include an outwardly extending ridge substantially parallel to the second surface, and the cap further includes an inner perimeter groove for engaging the ridges. Preferably, the battery support comprises a plurality of posts. Preferably, the cap includes a beveled surface located to contact the battery. Preferably, the electronics includes a light emitting diode (LED).

The invention further provides a switchable light source for a flying disc comprising: an electronics housing including a plurality of non-conductive flexible base elements and a cap covering the base elements; and a switch mechanism comprising: a cam located on the cap; one of the base elements, and a conductive switch element in contact with the one base element; the cam, the one base element and conductive switch element located so that when the cap is rotated, the cam moves the base element to activate the switch. Preferably, the switchable light source further includes a battery located between the one of the base elements and the cap. Preferably, the battery includes a pair of terminals, the flying disc further including a light emitting diode (LED) having a first lead located in contact with one of the terminals and a second lead located substantially adjacent to one of the base elements.

The invention also provides a method of illuminating a flying disc, the method comprising: providing a flying disc having an electronics housing, an electronics housing cap, and a light source; placing a battery in the electronics housing; securing the battery in the electronics housing by placing the cap on the electronics housing without turning on the light source; and rotating the cap to turn on the light source. Preferably, the electronics housing includes a plurality of flexible base elements wherein the securing comprises the cap bending the flexible base elements to grip the battery. Preferably, the placing comprises placing a dual battery assembly in the electronics housing.

In another aspect, the invention provides a method for switching a light source for a flying disc including a base structure including a plurality of flexible non-conducting base elements, a cap that covers the base elements, a battery assembly having a first terminal and a second terminal located between the base elements and the cap; and a light emitting diode (LED) having a first lead located in contact with the first terminal and a second lead located substantially adjacent to one of the base elements, the method comprising: rotating the cap and thereby: pinching the one of the base elements towards the second terminal; and contacting the second lead with the second terminal.

The invention also provides a flying disc comprising: a disc-shaped body member having a first surface and a second surface and terminating at its periphery in an annular rim; the rim extending in a direction substantially away from the plane of the first surface and together with the second surface defining a semi-enclosed space; a light source for illuminating the flying disc; a photovoltaic cell located on the first surface; and a rechargeable battery connectable to the photovoltaic cell and the light source.

In another aspect, the invention provides a dual battery adapter comprising: a battery holding member having a first slot adapted to hold a first disc-shaped battery and a second slot for holding a second disc-shaped battery; the battery holding member sized and shaped to fit snugly into a battery chamber designed for a third disc-shaped battery that is larger than the first and second battery.

DESCRIPTION OF THE PREFERRED EMBODIMENT

Figure 1:
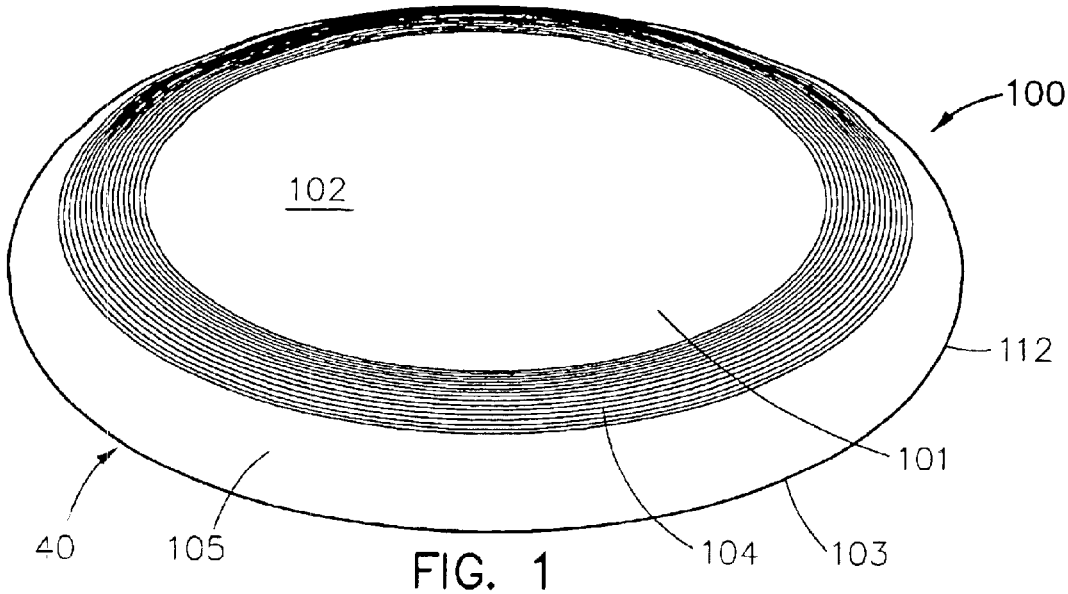
FIG. 1 shows a perspective view of the preferred embodiment of an illuminated flying disc according to the invention.

FIG. 1 is a perspective view of a flying disc 100 according to the invention. Flying disc 100 preferably includes flying disc body 103 including a disc-shaped body member 101, an annular rim 112, and a curved connecting body portion 106 connecting disc 101 and rim 112. Disc-shaped body member 101 has a first surface 102, and rim 112 extends in a direction substantially away from the plane of the first surface 102. Here, a direction substantially away from the plane of the first surface means that the direction is not along the plane of the first surface but makes a substantial angle with the plane of the first surface. Preferably, this angle is substantially 90 degrees, but may vary from about 30 degrees to 150 degrees.

Figure 2:
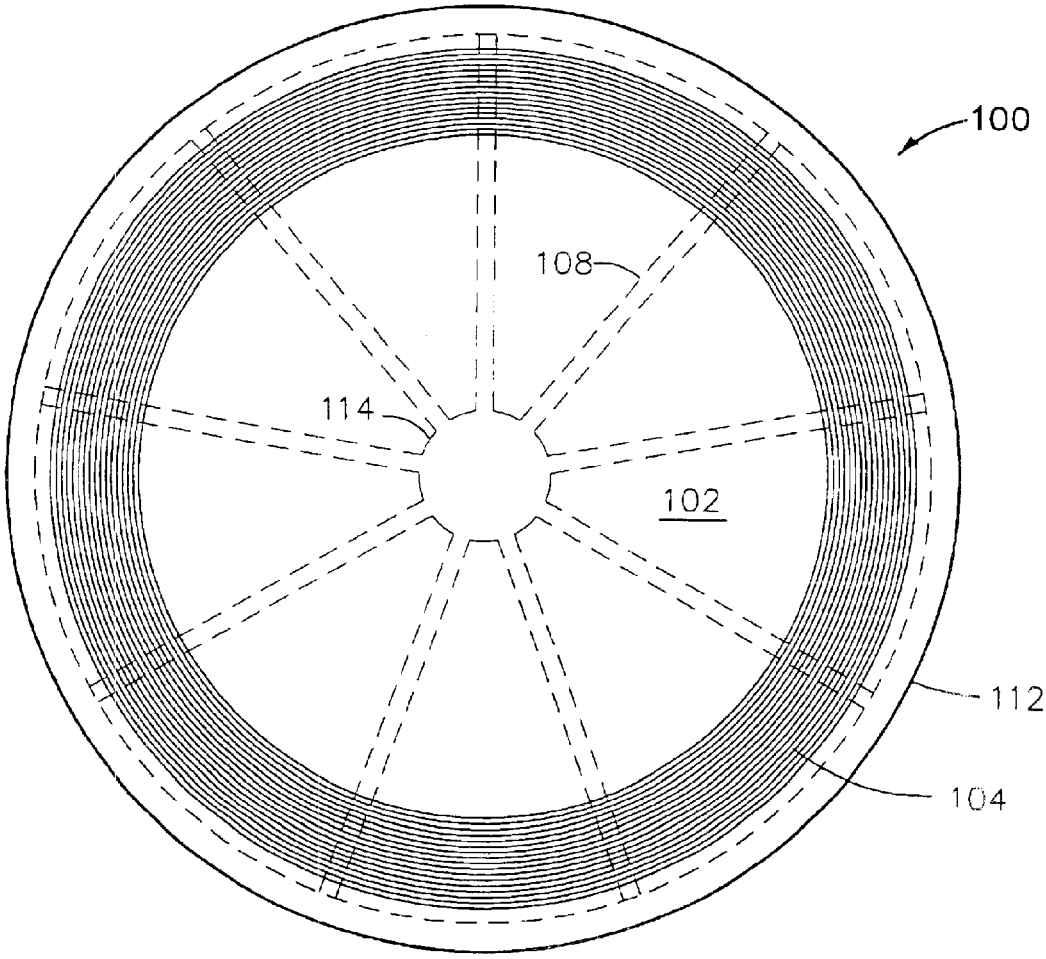
FIG. 2 shows a top plan view of the illuminated flying disc of FIG. 1.
Figure 3:
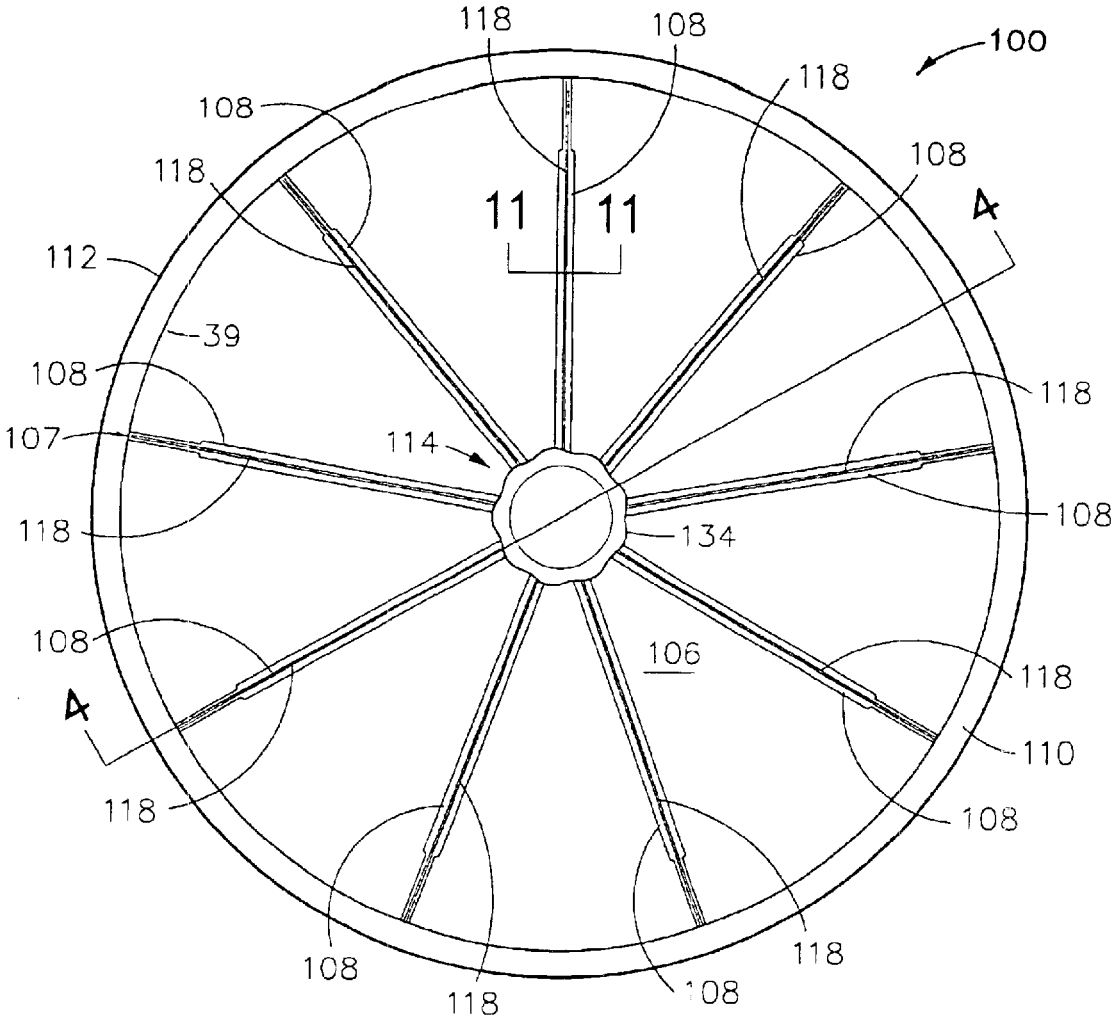
FIG. 3 shows a bottom plan view of the illuminated flying disc of FIG. 1.

In addition to first surface 102, which is the outer surface of the disc-shaped portion of body 103, it is useful to consider an aerodynamic surface 40, which is defined to include surface 102, the outer surface of connecting portion 105, and the outer portion of rim 112. Preferably, ridges 104 are formed in aerodynamic surface 40, preferably in connecting 105 region near disc 101. FIG. 3 is a bottom view of flying disc 100 showing a second or bottom surface 106, which is the surface extending on the opposite side of disc 101 from surface 102 and the bottom side of connecting portion 106, a plurality of ribs 108, a plurality of optical fibers 118, and electronics housing 114 including electronics housing cap 134. Preferably, each optical fiber 118 is enclosed in one of ribs 108, and each rib 108 contains an optical fiber 118. Each rib 108 is adhesively affixed or welded to second surface 106, and each optical fiber 118 is frictionally retained in a rib 108 as will be described in detail below in connection with FIG. 11. Electronics housing 114 (FIG. 4) including cap 134 are preferably located centrally on second surface 106, and ribs 108 and optical fibers 118 preferably extend radially from electronics housing 114 along second surface 106 of flying disc 100. Output end 107 of each optical fiber 118 preferably does not penetrate annular rim 112 of flying disc 100, but terminates without penetrating inside edge 39 of annular rim 112. Annular rim 112 ends at edge 110 of flying disc 100. A top view of flying disc 100 is shown in FIG. 2 illustrating the preferred relative locations of ribs 108, electronics housing 114, ridges 104, and rim 112.

Figure 4:
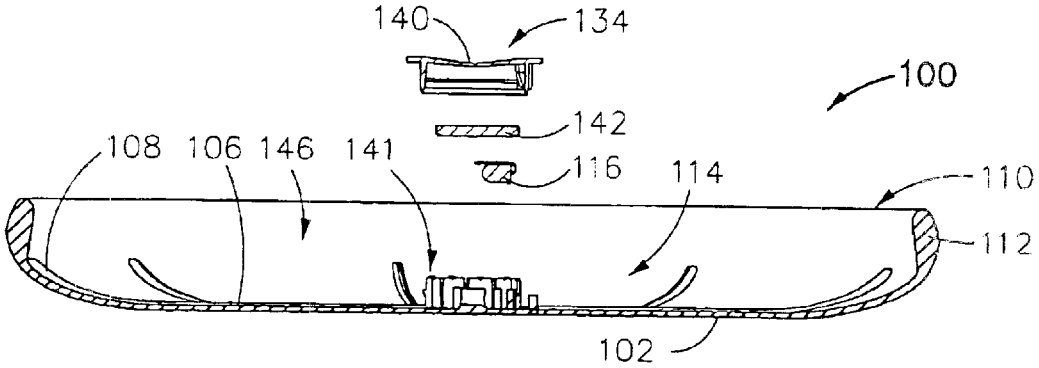
FIG. 4 shows a cross-section view of the preferred embodiment of an illuminated flying disc according to the invention taken through line 4—4 of FIG. 3.

FIG. 4 is a cross-section view of flying disc 100 taken through line 4—4 of FIG. 3. Flying disc 100 includes a semi-enclosed space 146 defined by annular rim 112, edge 110, and second surface 106. FIG. 4 also shows an exploded view of electronics housing 114, which includes a battery assembly which can consist of a single battery 142, a pair of batteries, a pair of batteries in an adapter 144 (FIG. 6B), or any other battery combination. Electronics housing 114 also includes an LED 116, a switch 129 (shown in FIGS. 7A–7D), a cap 134, and a base structure 141. Preferably, electronics housing 114 does not protrude through the plane of first surface 102. Cap 134 snaps on top of base structure 141 via tabs and grooves which are described below.

Figure 5:
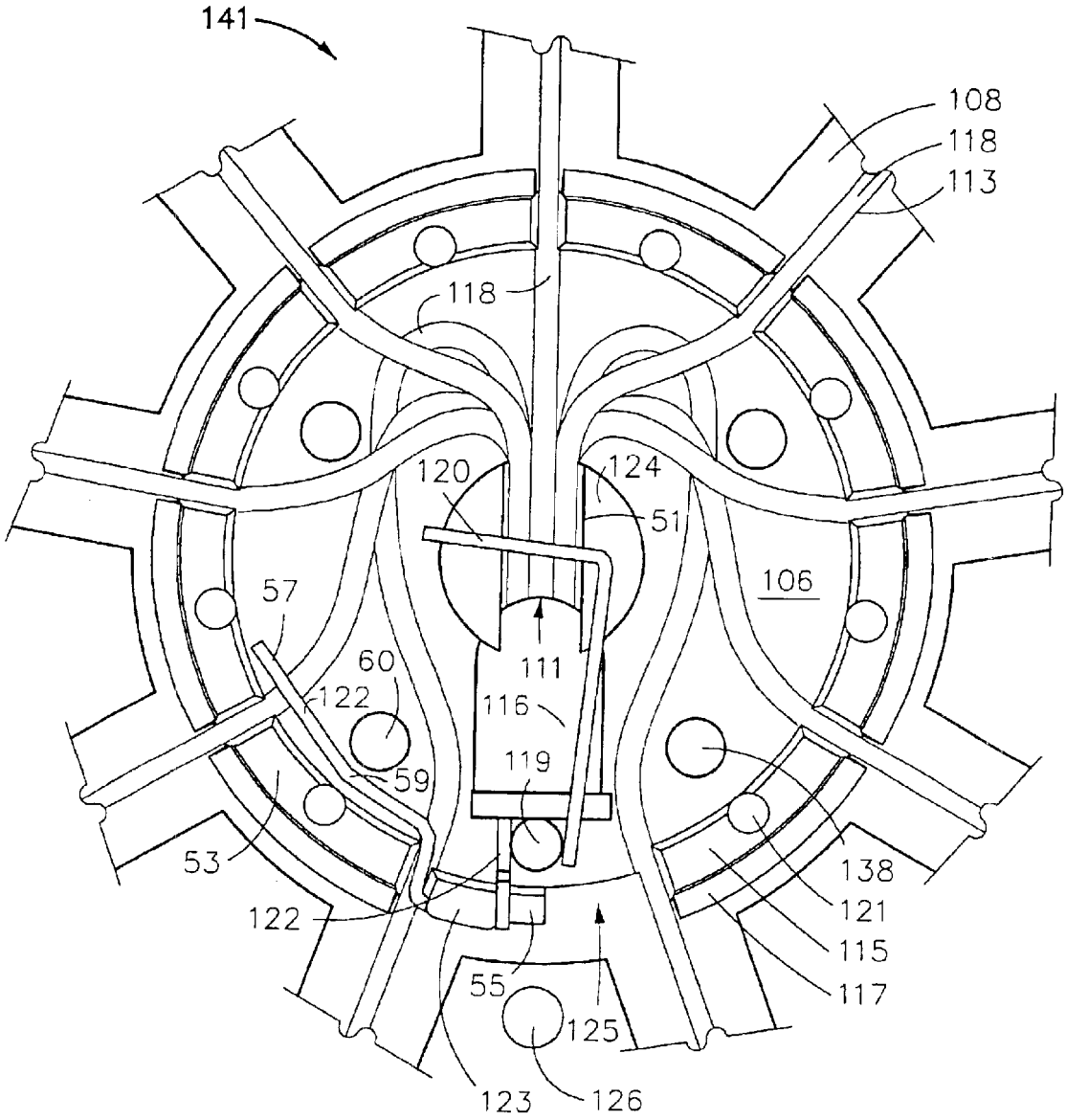
FIG. 5 is a plan view illustration of the electronics housing and related components of the illuminated flying disc of FIG. 1 with the battery and cap removed.

FIG. 5 is a plan view illustration of base structure 141 with battery 142 and cap 134 removed. Base structure 141 preferably includes a plurality of base elements 115 and a base lever element 123, which are perhaps better understood seen in perspective in FIGS. 7A and 7B, post supports 138 to support battery 142 above LED 116, light source supports 124, and light source bracket 119. Base elements 115 and base lever element 123 are arranged in a substantially circular arrangement and are attached to second surface 106. Preferably, each base element 115 includes a base member flange 121 and a base element ridge 117, which ridge engages cap groove 148 (shown in FIG. 9). Base lever element 123 includes a notch 55. LED 116 is attached to optical fibers 118 and is attached to second surface 106 of flying disc 100 via light source mounts 124 and light source bracket 119. Input end 111 of each optical fiber material 118 terminates near, or, preferably, is embedded in, the radiant end of LED 116. As illustrated in FIG. 5, light source mounts 124 are shown facing each other and defining a channel 51 between the two through which optical fibers 118 pass prior to their connection with LED 116. LED 116 is gripped by light source mount 124 and bracket 119. Optical fibers 118 preferably are attached to second surface 106 of flying disc 100 by ribs 108. Preferably, the optical fibers extend from LED 116 between light source mounts 124, then each optical fiber 118 passes between two base elements 115 which hold optical fiber 118 in place, and then is retained in rib 108.

LED 116 includes a first lead 120 and a second lead 122. Preferably, first lead 120 extends from LED 116 and is routed on top of light source mount 124. Second lead 122 extends from LED 116 and is routed past light source bracket 119 and through notch 55 in lever base element 123, then it is routed around the external portion of lever base element 123 and back inside adjacent base element 53 of base structure 141 where end 57 is held between element 53 and post 60. Preferably, lever base element 123 does not include a base member flange 121 like that found on other base elements 115. Second lead 122 preferably includes a slight crimp 59 where it bends around post 60. Preferably, flying disc 100 further includes a pin 126 to engage detent tab 135 (shown in FIGS. 7C, 7D, and 10) of cap 134. Battery 142 is illustrated in more detail in FIG. 6A.

Figure 6A:
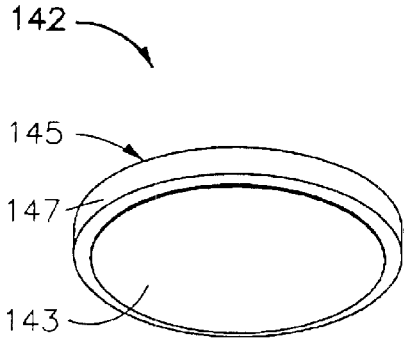
FIG. 6A shows a perspective view of a single battery according to the invention.

FIG. 6A is an illustration of battery 142. Battery 142 is preferably a button cell or coin cell battery and includes a first terminal 143 and a second terminal 145 having a second terminal side 147. Preferably, first terminal 143 contacts first lead 120 continuously and second terminal side 147 contacts second lead contact area 137 (FIG. 7B) when switch 129 is in the ON position. Switch 129 includes cap 134, pin 126, cam 128 (shown in FIG. 10), detent tab 135, and lever base element 123. Lever base element 123 is illustrated in more detail in FIGS. 7A and 7B.

Figure 6B:
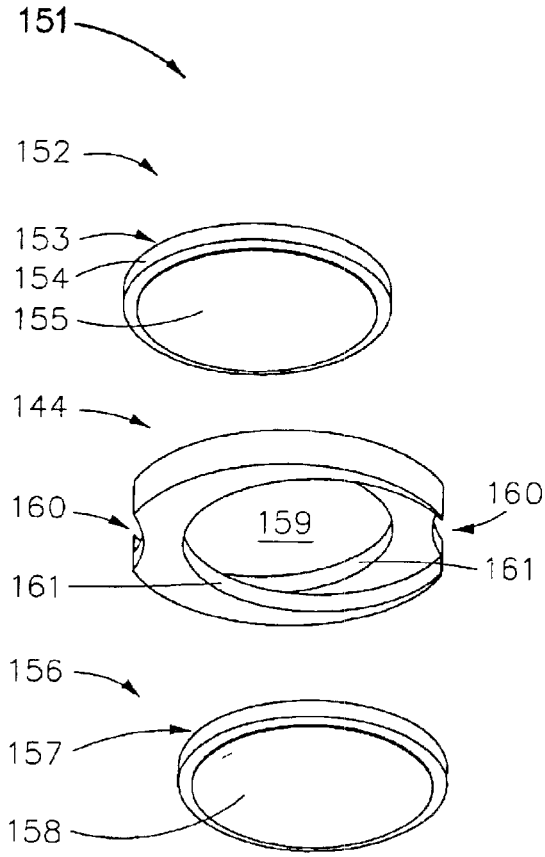
FIG. 6B shows a perspective view of a dual battery and accompanying adapter according to the invention.

FIG. 6B illustrates an optional dual battery assembly 151 including top battery 152, bottom battery 156, and battery adapter 144. Battery assembly 151 matches battery 142 in size and is therefore interchangeable with it. Top battery 152 and bottom battery 156 are preferably button cell or coin cell batteries and fit in corresponding circular recesses 161 in battery adapter 144 with first terminal 155 of top battery 152 in contact with second terminal 157 of bottom battery 156 through an opening 159 in battery adapter 144. Battery adapter 144 includes two symmetrical notches 160 in its edge. When batteries 152 and 156 are installed in adapter 144, the crescent-shaped sliver of top battery 156 extends beyond the notch on the left and a crescent-shaped sliver of bottom battery 156 extends beyond the notch on the right in the figure. When dual battery assembly 151 is installed in base structure 141, first terminal 155 of bottom or first battery 156 contacts first lead 120 continuously and second terminal side 154 of top or second battery 152 extending beyond corresponding notch 160 contacts second lead contact area 137 when the switch 129 is in the ON position. Dual battery assembly 151 permits the battery voltage to be doubled. The symmetrical structure of battery adapter 144 enables the adapter to be used with the batteries in either the positive poles up position or the positive poles down position. This makes it easier to insert the batteries in the battery compartment. It allows the user to first concentrate on placing both batteries properly in the adapter, and then concentrate on placing the combination of adapter and batteries properly in the battery compartment.

Figure 7A:
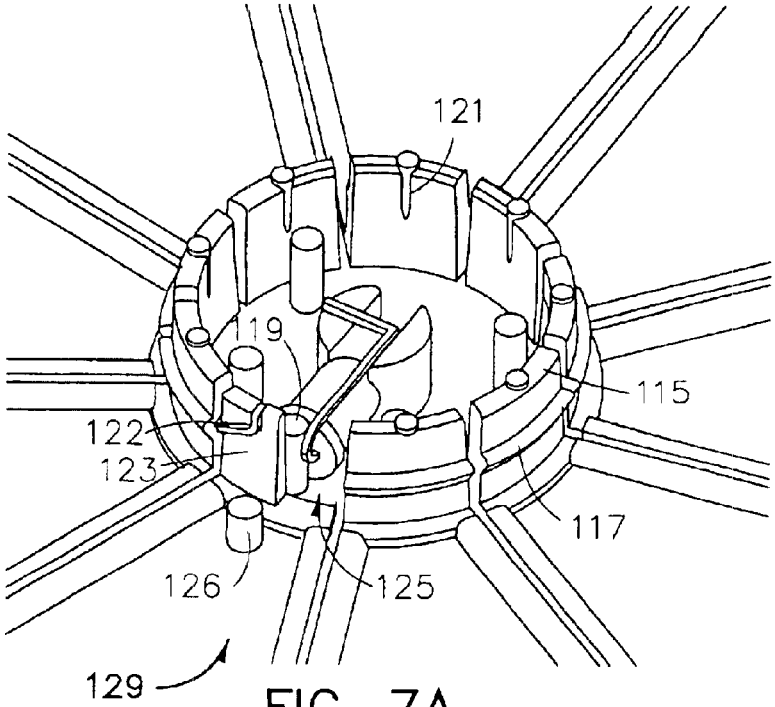
FIGS. 7A and 7B are perspective views of the electronics compartment and related components of FIG. 5 with the optical fibers removed to better illustrate the switch mechanism of the preferred embodiment of an illuminated flying disc according to the invention.

FIG. 7A illustrates a part of switch 129, lever base element 123, of flying disc 100. Lever base element 123 preferably is located between two base elements 115. The view in FIG. 7A is looking from edge 110 toward the central portion of base member 141. Preferably, lever base element 123 is narrower than base elements 115 to form a cam opening 125 where cam actuator 63 (FIG. 7C) is located when switch 129 is in the OFF position.

Figure 7B:
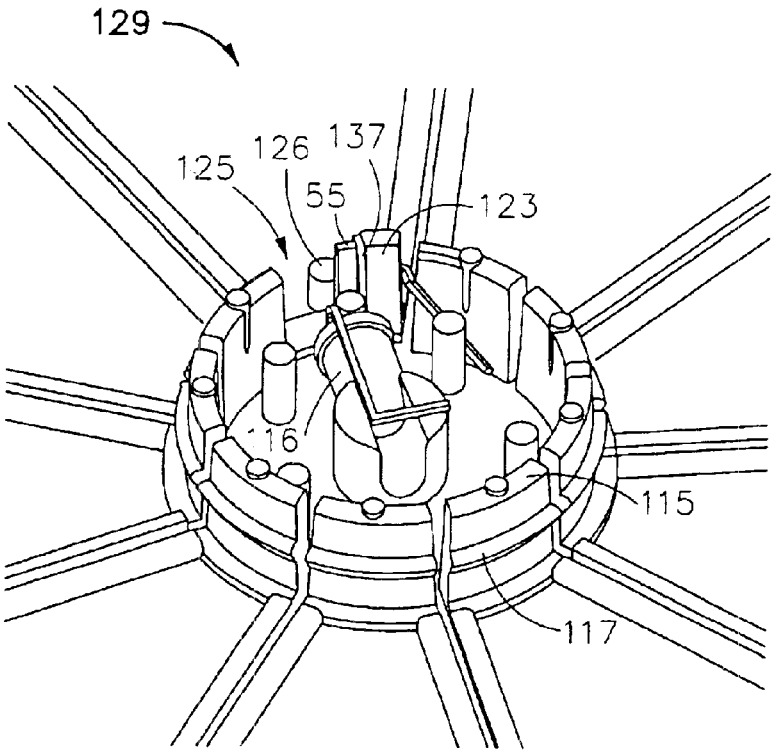

FIG. 7B illustrates the other side of lever base element 123 as viewed from the central portion of base member 141 toward edge 110. Second lead 122 is shown located between light source bracket 119 and lever base element 123. Lead 122 contact portion 137 is further shown located inward of lever base element 123 prior to lead 122 being routed over notch 55 of lever base element 123 and around the exterior portion of lever base element 123. Preferably, second lead contact area 137 contacts battery 142 when the cap is in the ON position.

Figure 8:
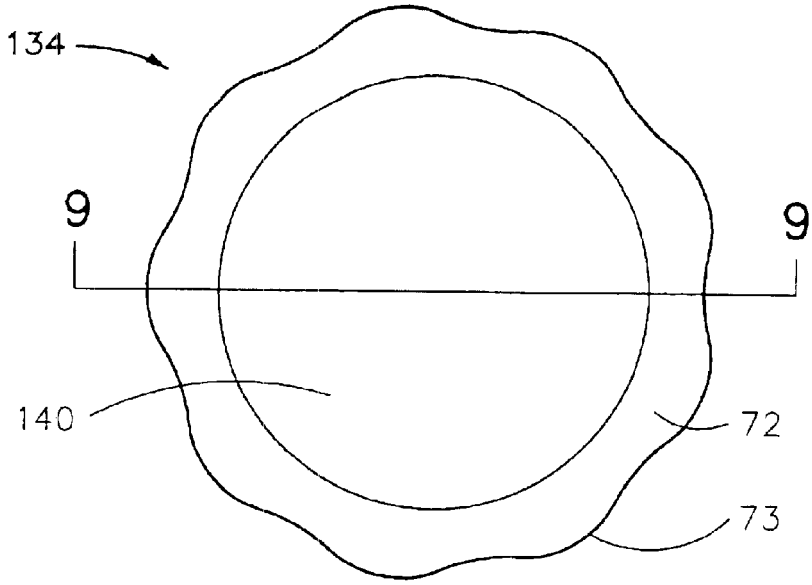
FIG. 8 shows a plan view of the top of the cap of the illuminated flying disc of FIG. 1.
Figure 9:
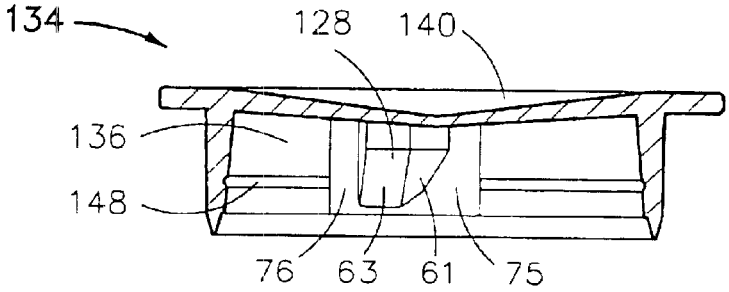
FIG. 9 illustrates a cross-section of the cap taken through line 9—9 of FIG. 8.
Figure 10:
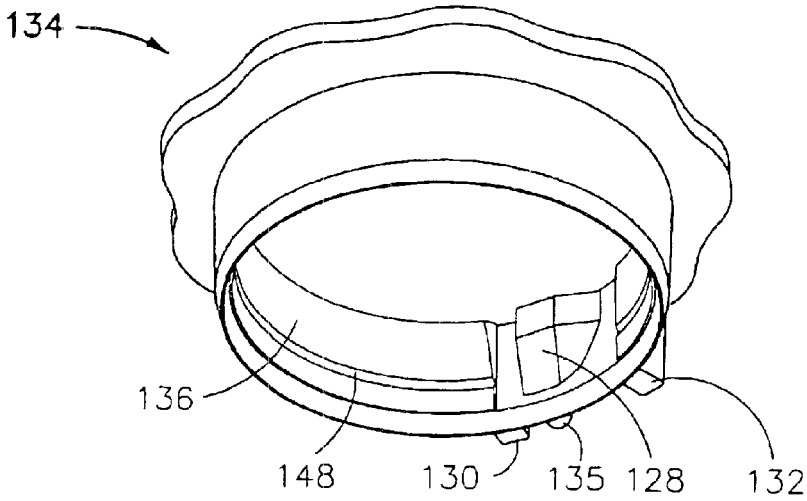
FIG. 10 illustrates a perspective bottom view of the cap of FIG. 8.

FIG. 8 is a top plan view of cap 134, FIG. 9 illustrates a cross-section of cap 134 through line 9—9 of FIG. 8, and FIG. 10 is a bottom perspective view showing the inside of cap 134. Cap 134 includes a cap handle 72, a cap body 136, a cam 128, a bevel 140, a cap groove 148 located substantially around the inside perimeter of cap body 136, a first stop 130, a second stop 132, and a detent tab 135. Handle 72 includes ridges 73 that make it easier to grasp the cap. Cap groove 148 engages base element ridge 117 of the plurality of base elements 115 to provide a fastener mechanism for cap 134 to be attached to base member 141. Beveled portion 140 is located on the inside of the cap that extends slightly toward second surface 106 when in position on base member 141. Bevel 140 presses against battery 142 (FIG. 4) to force the battery into contact with first lead 120 (FIG. 5). Cam 128 is preferably located on the inside perimeter of cap body 136. Cam 128 includes a ramp 61 and an actuator portion 63. A ramp notch 75 is formed in cap body 136 adjacent ramp 61, and an actuator notch 76 is formed in cap body 136 adjacent actuator 63. Cap body 136 is substantially circular and fits snuggly over the plurality of base elements 115. First stop 130 is located to contact pin 126 to provide a stop for the OFF position, and second stop 132 is located to contact pin 126 and provide a stop for the ON position. Detent tab 135 secures switch 129 in the ON position.

Figure 7C:
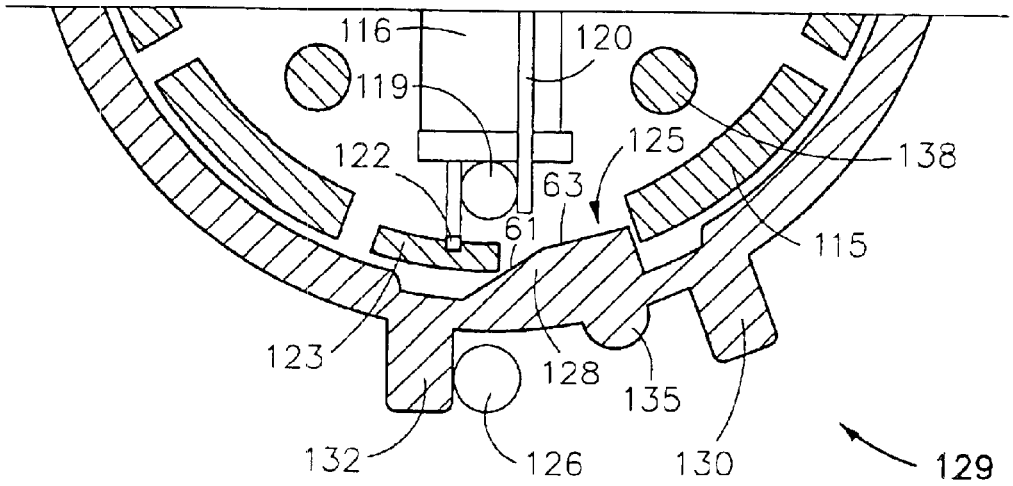
FIG. 7C is a partial plan view of a portion of the electronics housing and related components of FIG. 5 with the switch in the OFF position.
Figure 7D:
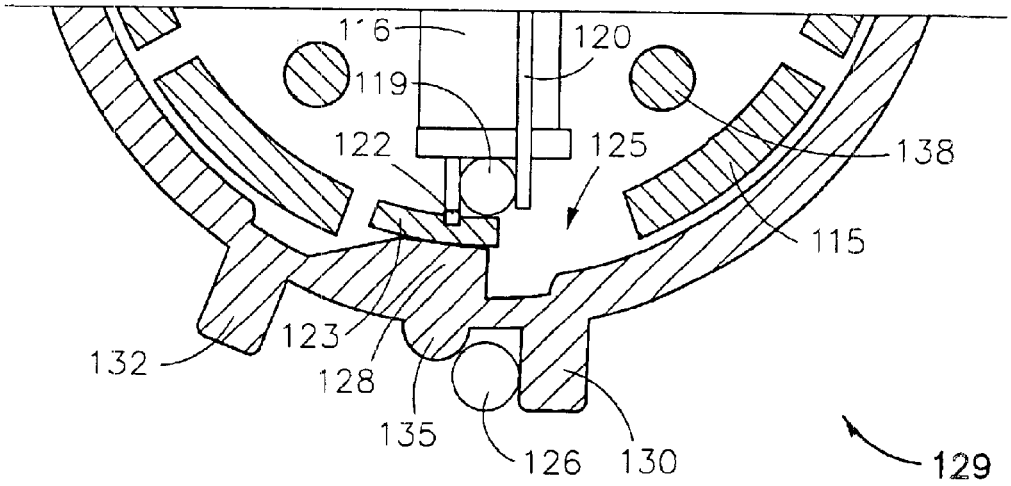
FIG. 7D is the view of FIG. 5 with the switch in the ON position.

FIG. 7C illustrates switch 129 in the OFF position. In this position, activator portion 63 of cam 128 is located in cam opening 125 and second stop 132 is in contact with pin 126. FIG. 7D illustrates switch 129 in the ON position. In this position, cam 128 is located in contact with lever base element 123. Detent 135 and first stop 130 are in contact with pin 126. Cap body 136 (shown in FIG. 8) rotates between these two positions.

Figure 11:
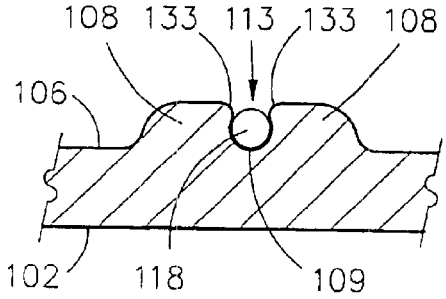
FIG. 11 is a cross-section view of a rib and optical fiber material taken through line 11—11 of FIG. 3.

FIG. 11 illustrates a cross-section of a rib 108 and an optical fiber 118 located within rib 108 adjacent to second surface 106. Rib 108 can be one piece or several pieces and forms a channel 109 into which optical fiber 118 fits. Rib 108 further includes a rib opening 113 that is narrower than channel 109 to form a lip 133 that mechanically or frictionally retains optical fiber material 118 in rib 108.

Figure 12:
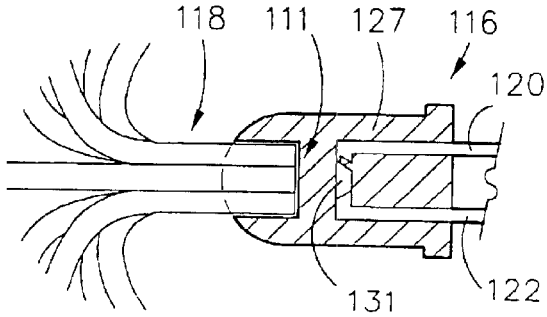
FIG. 12 is a cross-section of the LED and optical fiber materials of the illuminated fly disc taken through a plane parallel to the paper in FIG. 5.

FIG. 12 illustrates a plurality of input ends 111 of optical fiber material 118 embedded in a dielectric casing 127 of LED 116. LED 116 further includes a semiconductor chip 131 and leads 120 and 122.

Figure 13:
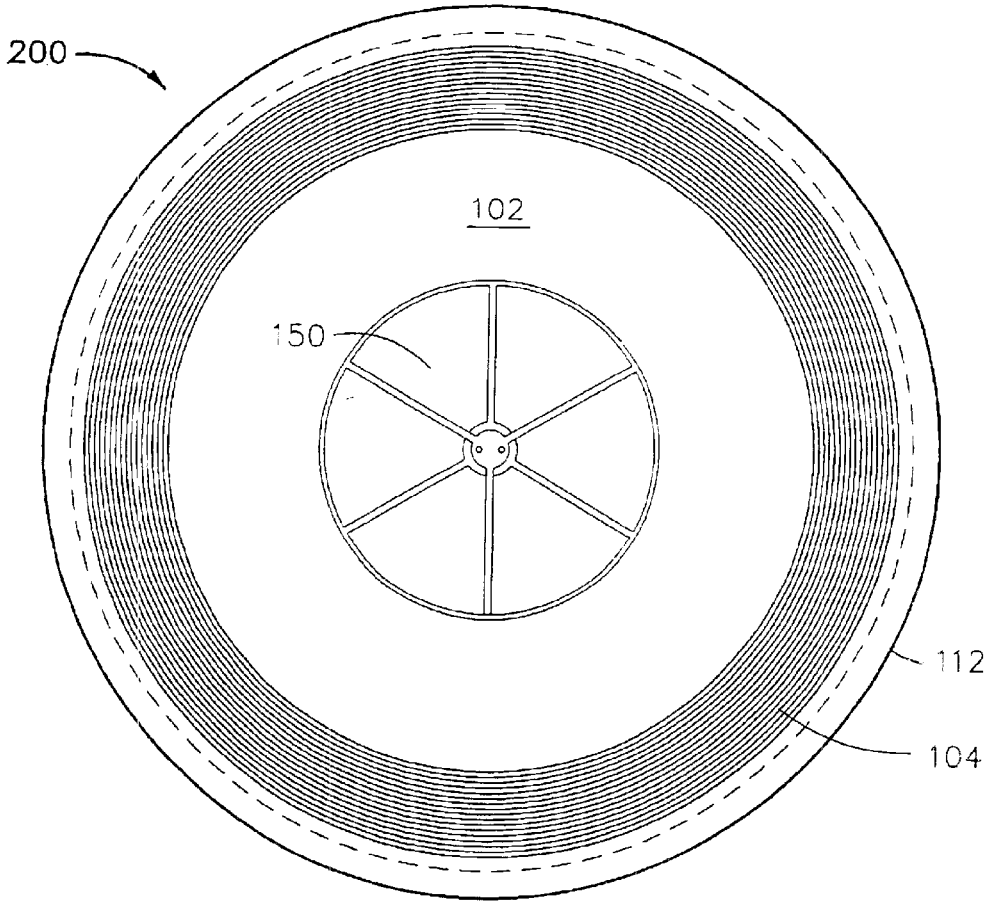
FIG. 13 shows a top plan view of an alternative embodiment of an illuminated flying disc according to the invention.

FIG. 13 illustrates another embodiment of flying disc 200 with a plurality of photovoltaic cells 150 located on top of first surface 102.

A novel feature of flying disc 100 is that base structure 141 is not a continuous member or rim, but a plurality of base elements 115 having a degree of flexibility that permits the elements to cooperate independently with battery 142 and cap 134. The independent and flexible nature of base elements 115 enables a tight fit between base structure 141 and cap 134. Base member flanges 121 assist further with holding the battery in place. Specifically, as cap 134 is placed over the plurality of base elements 115, base member flanges 121 come in contact with the battery first and cause base elements 115 to resist being bent farther inward. This adds to the tight fit of cap 134, base structure 141, and battery 142. When cap 134 is snapped on top of base member 141, base elements 115 bend slightly and exert pressure back against cap 134, thereby creating a firm enclosure. Also, because base elements 115 are independent, they grip the battery better and keep it centered, so that the battery can't slide around, which makes the entire electronics housing 114 a more rigid structure. That is, battery 142 is a structural component of electronic housing 114, thereby adding additional strength to electronics housing 114. In addition, as cap 134 is being placed over the plurality of base elements 115, cap groove 148 engages base element ridge 117 of each individual base element 115 to create a tight secure fastening mechanism. When cap 134 is placed on base elements 115, the base elements and cap grip the battery forming a rigid electronic housing structure that protects the disc-illuminating electronics.

Another novel feature of flying disc 100 is the operation and compactness of switch 129 and electronics housing 114. Cam 128 of switch 129 slides from a nonengaged first position as shown in FIG. 7C to an engaged position as shown in FIG. 7D. In the first position, cam 128 rests in the recess of cam notch 125, thereby applying minimum or no pressure on lever base element 123. This minimum pressure is insufficient to force lever base element 123 and second lead 122 to make contact with the side of battery 142. In the second position, lever base element 123 rides up cam ramp 61 and actuator portion 63 slides adjacent to lever base element 123 and thereby forces lever base element 123 and second lead 122 to make contact with the side of battery 142. The tight stationary grip exerted on battery 142 by the plurality of base elements 115 and base member flanges 121, coupled with the inward force created by cam 128 being rotated to the ON position, creates a binding effect on second lead 122 and second terminal side 147.

Cap 134 further adds to the rigidity of the electronics housing 114 structure. Cap 134 preferably includes a protruded or beveled portion 140 that extends toward battery 142 when cap 134 is snapped to base member 141. Preferably, beveled portion 140 is centered on battery 142 to hold the battery in place against post supports 138 and lead 120 without hindering the rotatable nature of switch 129.

In addition to the cam 128 mechanism described above, pin 126 provides stops for first stop 130 and second stop 132 to rotate therebetween. Furthermore, detent tab 135 and first stop 130 create a secure and stable position for switch 129 when in the ON position to prevent switch 129 from moving inadvertently during use.

Another novel feature of flying disc 100 is the battery 142 placement within electronics housing 114. As shown in FIG. 5, coin cell battery 142 is preferably placed in a horizontal parallel position with respect to second surface 106 of flying disc 100. Post supports 138 extend outward from second surface 106 just beyond LED 116 and light source mount 124 to create a support for battery 142 to rest in a substantially horizontal position. While in this horizontal supported position, first terminal 143 of battery 142 rests against first lead 120 of LED 116. Post supports 138 provide support for the battery and create a recess for LED 116, light source mount 124, and first lead 120. In another aspect of the present invention, post supports 138 may be a shelf molded around the inside perimeter of base member 141 or an inwardly extending tab on each of base elements 115.

Flying disc 100 may include one or more light source mounts 124. Light source mounts 124 preferably tightly grip LED 116 or other light source used in flying disc 100. In addition, the light source mounts preferably provide a guide for optical fiber material 118 to LED 116. Furthermore, light source bracket 119 adds further placement rigidity for LED 116. Light source bracket 119 also allows second lead 122 to extend from LED 116 and route up, over, and around lever base element 123.

Ribs 108 may be one single piece, or several pieces. Herein, the term "rib" means the structure enclosing channel 109, such structure affixed to and extending above or below the plane of second surface 106 of flying disc 100. Preferably, ribs 108 extend from base member 141 to annular rim 112 of flying disc 100. Ribs 108 generally have a rib opening 113 that allows placement of optical fiber material 118 inside of ribs 108. In addition, rib opening 113 has a slightly narrower width than channel 109 of ribs 108 to facilitate the retention of optical fiber material 118 in channel 109. Preferably, optical fiber material 118 is located between base elements 115 just after exiting the inward end of ribs 108. In another aspect of flying disc 100, optical fiber material 118 could be routed through small holes drilled in the base elements as well.

Input end 111 of each of optical fibers 118 is embedded in LED 116 to provide excellent light transmitting properties through optical fiber material 118. Input end 111 of optical fibers 118 is preferably located inside dielectric casing 127. Preferably, an opening is drilled, molded, or formed in the center of dielectric casing 127. Next, a bundle of optical fibers 118 is directed toward the opening in dielectric casing 127 as shown in FIG. 12. Preferably, a suitable adhesive (preferably a transparent polymeric adhesive such as epoxy) is used to bond optical fiber material 118 to LED 116 as well as to increase the efficiency of the transmission of light from LED 116. One or more optical fibers 118 may be used with flying disc 100. Output end 107 of optical fibers 118 extends outwardly toward annular rim 112 of flying disc 100, preferably terminating adjacent to curved annular rim 112, thereby illuminating through the flying disc and providing illuminating light around annular rim 112 of flying disc 100. The fact that the end of the optical fiber does not pass through the rim prevents shocks to the rim from being transmitted to the fiber. While the preferred optical fibers 118 is a conventional optical fiber product from an outside supplier, the term "optical fiber" includes an embodiment in which an optical fiber material is: fabricated with ribs 108; formed by making a channel in ribs 108, inserting optical fiber material in the channel, and then heating to form an optical path; or partially or fully embedded within flying disc body 103.

Although flying disc 100 has been described as basically a disc-shaped body member, another aspect of the present invention includes other gliding or flying bodies of differing shapes.

Preferably, the upper portion optionally includes at least one ridge 104 to spoil the airflow over flying disc 100 to allow for greater flight distances and stability. Ridge 104 may be on first surface 102, connecting portion 105, or both. Electronics housing 114 is adaptable to either a standard version flying disc or one including these ridges 104. The material of disc-shaped body member 101 may be a solid, translucent, clear, or phosphorescent plastic, rubber, polyolefin, or plexiglass.

The optical fiber may be of transmission or scintillating type, clear or colored, clad or unclad with materials being methacrylate, polyethylene, polyurethane or other suitable combinations or polymers, an example of which is Lumileen™ optical fiber by Poly-Optical Products, Inc.

LEDs may be single or multiple colored with clear or colored dielectric casing and integral connecting leads, an example of which is a "Precision Optical Performance AlInGaP LED Lamp" by Agilent, Inc.

Electronics housing 114 preferably extends no greater than 0.75 inches outward from second surface 106 and is preferably no greater in diameter than 2 inches. In the preferred embodiment, the diameter of rim 112 is substantially 10.5 inches, the diameter of cap 134 is substantially 1.5 inches, and the diameter of base structure 141 is substantially 1 inch. Preferably, the radius of electronics housing 114 is one-fourth or less of the radius of rim 112, and more preferably, one-fifth or less of the radius of rim 112. Most preferably, the radius of electronics housing 114 is one-seventh or less of the radius of rim 112. Electronics housing 114 can be made of similar materials described above for disc-shaped body member 101.

Switch 129 controlling LED 116 is activated by rotating cap 134 on base member 141. When LED 116 is lit, flying disc 100 is illuminated in many areas. First, the plurality of optical fibers 118 conducts light from the electronic light source to annular rim 112 of flying disc 100 and, when flying disc 100 rotates, these intense points of light form an apparent continuous band of light around the perimeter of flying disc 100. Second, the individual optical fiber materials 118 also glow along their length illuminating the lower surface of the disc in a radial pattern. Third, electronics housing 114 is translucent and "overflow" light from LED 116 makes the sides of electronics housing 114 and first surface 102 of flying disc 100 glow.

LED 116 may be replaced by any light source that will fit into the electronics housing of flying disc 100. Preferably, the electronic light source of flying disc 100 is LED 116, but can include other light sources such as Lasers, fluorescent lamps, incandescent lamps, and other electronic light sources commonly known in the art.

Replacement of battery 142 occurs by means of pulling straight up on cap 134 to expose battery 142. In another aspect of flying disc 100, many batteries may be employed to increase the power output to expand the types of electronic light sources that may be used in flying disc 100. For example, LEDs vary in color and power requirements, so increasing the number of button cell or coin cell batteries correspondingly increases the selection of colored LEDs that can be used in flying disc 100. In addition, rechargeable batteries can be used with embodiment 200, which includes a thin film of photovoltaic cells 150 to recharge the batteries during day use. In addition, battery(ies) 142 and 144 may be replaced by a small electric generator operated by the spinning motion of the flying disc, direct chemical to light energy sources, or other energy sources.

A tactile switch 129 is described in the preferred embodiment; however, other embodiments of the switch could include a centrifugal switch and/or a light sensor with associated circuitry in lieu of the tactile switch to provide for automatic activation of LED 116 when flying disc 100 is thrown in conditions of low light.

Ribs 108 may be adhesively attached to second surface 106 or molded as part of disc-shaped flying body 101. In addition, ribs 108 could be welded to disc-shaped flying body 101. Ribs 108 consist of one piece or several pieces that together form channel 109 to receive optical fiber material 118.

Another feature of the invention is that LED leads 120, 122 directly contact the battery. Herein, the term "LED leads" is limited only to the conductors imbedded in dielectric 127 and do not mean other conductors that may be connected to these conductors. Herein, the term "directly contact" means that the LED leads physically touch the battery, and does not include situations where significant other conductors are placed between the LED leads and the battery.

The invention has been described in language more or less specific as to methodical features. The invention is not, however, limited to the specific features described, since the device and methods herein disclosed comprise preferred forms of putting the invention into effect.

There has been described a novel flying disc 100 for use in athletics and recreation, a novel method of lighting the flying disc, and methods of switching the electronic light source on a flying disc 100. While the invention has been described in terms of specific embodiments, it should be understood that the particular embodiments shown in the drawings and described within this specification are for purposes of example and should not be construed to limit the invention which will be described in the claims below. Further, it is evident that those skilled in the art may now make numerous uses and modifications of the specific embodiments described, without departing from the inventive concepts. For example, now that the advantage of utilizing the leads of the electronic light source with a coin cell battery and a compact tactile switch has been described, other component arrangements than those described can be substituted. It is also evident that equivalent structures and processes may be substituted for the various structures and processes described. Consequently, the invention is to be construed as embracing each and every novel feature and novel combination of features present in and/or possessed by the flying disc described.

What is claimed is:

1. An aerodynamic toy/athletic device comprising:

a gliding body terminating at its periphery in an annular rim;

a light source attached to said gliding body, said light source including only one light emitting diode (LED), said LED comprising a semiconductor chip embedded in a dielectric casing; and a plurality of optical fibers attached to said gliding body, each said optical fiber having one end embedded in said dielectric casing.

2. An aerodynamic toy/athletic device as in claim 1 wherein said LED is substantially centrally located on said gliding body.

3. An aerodynamic toy/athletic device as in claim 1 wherein said light source further includes a battery, said LED further includes a pair of electrical leads, and said electrical leads directly contact said battery.

4. An aerodynamic toy/athletic device as in claim 1 wherein said gliding body comprises a disc-shaped body member having a first surface and a second surface and terminating at its periphery in an annular rim; said rim extending in a direction substantially away from the plane of said first surface and together with said second surface defining a semi-enclosed space.

5. An aerodynamic toy/athletic device as in claim 4 and further including a plurality of ribs attached to said second surface and wherein one of said optical fibers is located in each of said ribs.

6. An aerodynamic toy/athletic device as in claim 5 wherein each of said ribs further includes a channel formed in said rib and said optical fiber associated with said rib is located in said channel.

7. An aerodynamic toy/athletic device as in claim 6 wherein said channels do not penetrate the inside edge of said rim.

8. An aerodynamic toy/athletic device as in claim 6 wherein said disc-shaped body, said rim, and said channels are translucent.

9. An aerodynamic toy/athletic device as in claim 6 wherein said ribs further include an opening formed in said ribs and wherein said opening has a smaller diameter than said channel.

10. An aerodynamic toy/athletic device as in claim 1 wherein said dielectric casing comprises epoxy.

* * * * *